United States Patent [19]

Volk

[11] Patent Number: 4,993,749

[45] Date of Patent: Feb. 19, 1991

[54] MEMORANDUM BOOK AND SHEETS THEREOF

[76] Inventor: Victor F. Volk, 646 Snug Harbor Dr., Boynton Beach, Fla. 33435

[21] Appl. No.: 541,385

[22] Filed: Jun. 21, 1990

[51] Int. Cl.[5] ..... B42D 1/00

[52] U.S. Cl. ..... 281/38; 281/15.01; 283/63.01; 283/114

[58] Field of Search ..... 281/22, 15.1, 38; 283/63.1, 64.1, 114

[56] References Cited

U.S. PATENT DOCUMENTS

| | | | |
|---|---|---|---|
| 329,307 | 10/1885 | Gerhard | 281/15.1 |
| 672,171 | 4/1901 | Kittredge | 281/38 |
| 814,699 | 3/1906 | Hoey | 281/38 |
| 1,043,511 | 11/1912 | Davidson | 281/38 |
| 1,199,170 | 9/1916 | Friend | 281/38 |
| 1,462,683 | 7/1923 | Bush et al. | 281/15.1 |
| 1,927,266 | 9/1933 | Huttner | 281/38 |
| 2,058,035 | 10/1936 | Rand | 281/38 |
| 2,687,902 | 8/1954 | Becker | 283/64.1 |
| 3,517,947 | 6/1970 | Bennett | 281/38 |
| 4,334,771 | 6/1982 | Ryan, Jr. | 283/114 |

*Primary Examiner*—Hien H. Phan
*Assistant Examiner*—Hwei-Siu Payer

[57] ABSTRACT

In a memorandum book the sheets of which have rectangular tear out areas a frame of paper is retained around each sheet. Sheets are differently colored so that the undersheet can be recognized when an area has been removed.

20 Claims, 1 Drawing Sheet

MEMORANDUM BOOK AND SHEETS THEREOF

BACKGROUND OF THE INVENTION

Memorandum books have long been known wherein the individual sheets were bound together at the side and had a vertical line of perforations adjacent to the binding. Each of the sheets was further divided horizontally by a plurality of lines of performations that defined individual strips which could be easily torn out when the memorandum that had been inscribed upon it was obsolete. The popularity of such memorandum books has greatly declined, however, due to the serious defect that after a book had been in use for a while and a large number of obsolete strips had been torn out it degenerated into a collection of miscellaneous strips. These strips could not be turned as a page unit and it became very difficult to find any individual memo. The present invention retains the integrity of the individual sheets even when areas have been torn out and provides a much more satisfactory and useful memo device.

SUMMARY OF THE INVENTION

I have invented a memorandum book that comprises a plurality of inscribable sheets, each comprising upper and lower horizontal strips and an integral outer vertical edge-strip that combine to form a supporting frame. The sheets comprise means for being bound together along their inner edges. Advantageously, the detachable areas are separated at their upper and lower borders by slits of sufficient length for a person to insert a finger to grip the area and tear it out of the book. Where the sheets are bound into a book by means of binder wires the horizontal slits may extend all the way to their inner edges. But, since this might make the sheets too difficult to handle before they are bound, I prefer to provide a short length of fine perforations extending from each of the horizontal slits to the bound edge of the sheet.

Where the sheets are permanently bound by sewing, glueing, or stapling they comprise weakened tear lines, such as lines of closely spaced perforations, that separate inner edge portions from the remainder of the sheets.

The inner borders of the outer vertical strips of my memorandum book are defined by weakened tear lines such, advantageously, as lines of closely spaced perforations, and advantageously also the outer vertical strips are reinforced by being folded back upon themselves. Advantageously also again, successive sheets of my memorandum book comprise contrasting surface coloring so that the sheet upon which a particular memo appears can be immediately identified and the remaining borders of detached areas become distinctly noticeable.

DETAILED DESCRIPTION OF PREFERRED EMBODIMENTS

Figure 1:
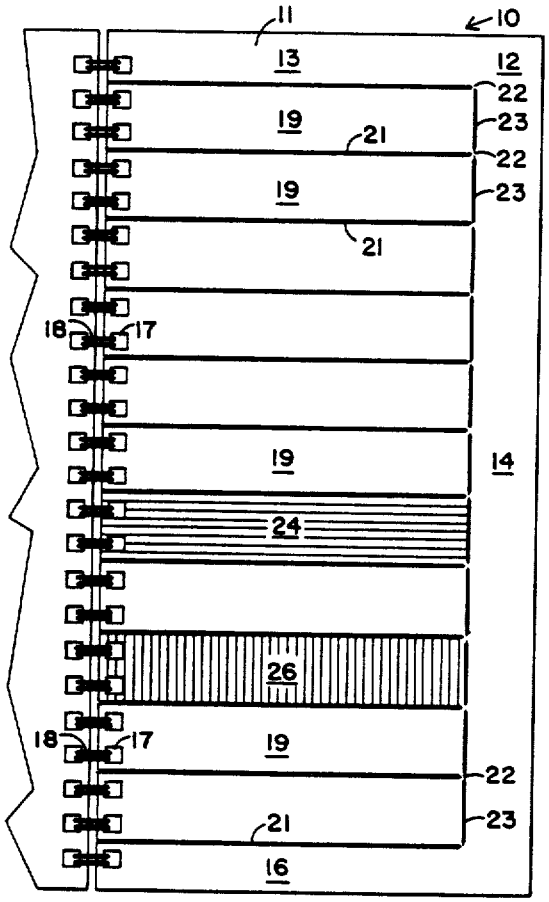
FIG. 1 is a plan view of an open page of my memorandum book.
Figure 2:
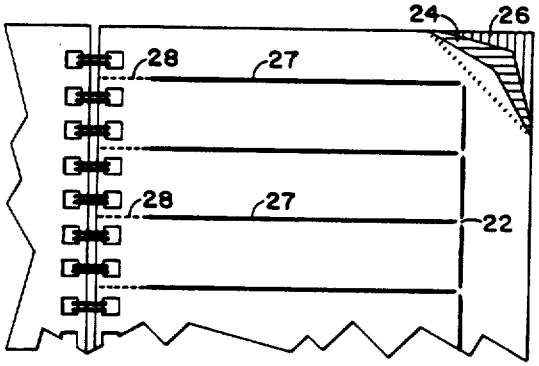
FIG. 2 is a plan view of a top portion of another embodiment of the memorandum book of FIG. 1, with corners turned back to exhibit coloring.

Referring first to FIG. 1 an open sheet 11 of my notebook 10 comprises an integral frame 12 made up of an upper horizontal strip 13, vertical edge strip 14, and lower horizontal strip 16. The sheet 11 is perforated in a known manner by binding means comprising rectangular perforations 17—17 to accept pairs of binding wires 18—18 of a continuous wire fixed frame that is in wide commercial use. The central portion of the sheet 10 that does not constitute the frame 12 is divided into a plurality of lateral parallel rectangular areas 19—19 by horizontal slits 21—21. The slits 21 extend through the left border of the sheet 10 but at the right, where the areas 19 abut the strip 14 said areas remain attached to said strip by small uncut tabs 22—22 between the slits 21 and vertical slits 23—23 that separate the areas 19 from the strip 14. As shown in FIG. 2 at the upper right side corner the paper of the sheets has been tinted to change their appearance so that a second sheet 24 is blue and a third sheet 26 is red. By this means a user can see immediately if an area has been torn from the sheet that is facing him. Thus in FIG. 1 the seventh area down the sheet 11 has been removed, exposing the blue area 24 beneath it, and in the ninth area, not only has that area been torn from the sheet 11 but also from the blue sheet beneath, to expose the red area 26 of the third sheet. Othermeans of changing the appearance of the individual sheets may be used, such as printing numerals or other indicia on each of the tear-out areas, within the scope of my invention.

In known types of tear-out memo pads where the individual pages lacked frames, once one or more strips had been torn out there was no way of knowing what page an individual memo belonged on. Here, not only can each memo be associated with its page but the page can be identified (within three) by its color even if it is not facing the observer.

Figure 3:
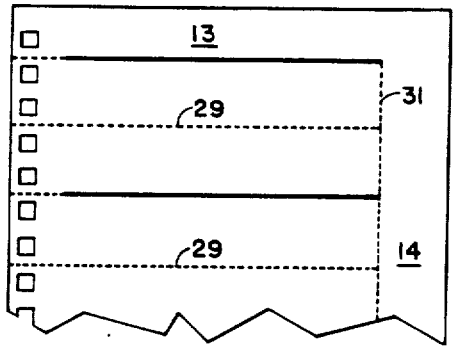
FIG. 3 is a plan view of a portion of another embodiment of a sheet used in my memorandum book.

In FIG. 2 horizontal slits 27—27 do not extend all the way to the left edge of the sheet but are continued by short weakened tear lines of perforations 28—28. By this means persons can still insert a finger into the slit to tear out the area but, since the sheets are continuous at both long edges, packets of sheets are easier to handle. This sheet construction is also illustrated in FIG. 3 with the additional feature that alternate strip areas are marked by weakened tear lines of perforations 29—29 and the removable areas are separated from the vertical frame strip 14 by a weakened tear line of perforations 31 instead of the slits 23.

Figure 4:
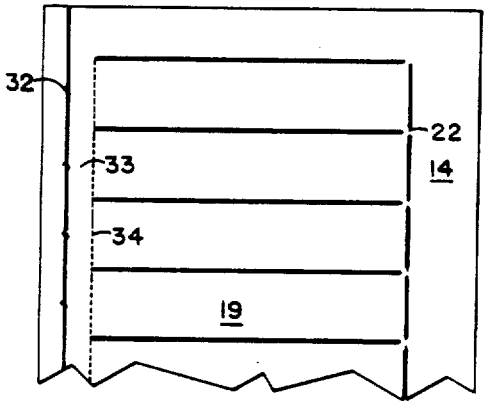
FIG. 4 is a partial plan view of an embodiment of my memorandum book with sewn binding.

FIG. 4 shows a memorandum book wherein the sheets have been bound together by stitching 32, in a known manner of book binding. Here the sheet frames have inner vertical strips 33 opposing the outer strips 14. The strip 33 is separated from the removable areas 19 by a vertical line of perforations 34 although vertical slits such as the slits 23 might also be used. It will be understood that, although I have shown weakened tear lines 28, 29, 31 formed by perforations, other known means, such as scoring, may be used for tear lines within the scope of my invention.

Figure 5:
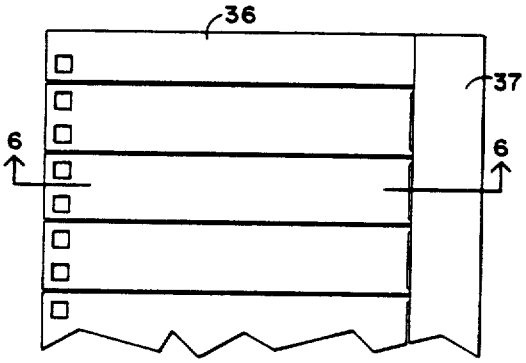
FIG. 5 is a partial plan view of another embodiment of a sheet for my memorandum book.
Figure 6:
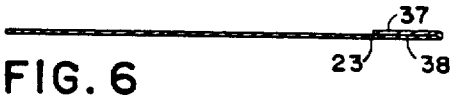
FIG. 6 is a section through the lines 6—6 of FIG. 5.

In FIGS. 5 and 6 I have shown a sheet 36 that is similar to the sheet 11 except that the outer edge of the sheet has been folded back to form a reinforced strip 37 that is glued down by a layer of adhesive 38. This guards against an inadvertent tearing of the strip 14 when the removable areas are torn out.

In using the memorandum book 10 of my invention memoranda are made on the areas 19 of sheet 11 and subsequent sheets 24, 26, etc., in the book. When a memorandum, such as the memorandum on the seventh area of the sheet 11, has become obsolete the area on which it has been written is torn out by inserting a finger through the appropriate slit 21, being careful not to tear the strip 14. If another memorandum has already been written on the seventh area of the blue tinted sheet 24 it will be recognized immediately because of its color that it is not on the sheet 11. If no memo occupies the exposed area one can be written in, as needed, without turning the page. When all of the areas 19 of the sheet 11 have been torn out the empty frame 12 can also be torn from the book. Of course, when there are only one or two long-lasting memos left on any sheet over a long period of time it is convenient to copy them onto a fresh sheet and remove the frame and remaining areas of the old sheet.

The foregoing description has been exemplary rather than definitive of my invention for which I desire an award of Letters Patent as defined in the appended claims.

I claim:

1. A memorandum book comprising a plurality of inscribable sheets, (A) each of said sheets comprising:

(1) upper and lower horizontal strips and an outer vertical edge strip integral therewith, said strips forming a supporting frame, and (2) a plurality of detachable rectangular areas, each of said areas extending inwardly from said edge strip, and (B) means for binding said sheets together along an edge thereof opposite said vertical edge strip.

2. The memorandum book of claim 1 wherein said binding means comprise binder wire, and end portions of each of said areas define at least one aperture for enclosing said binder wire.

3. The memorandum book of claim 1 wherein said outer edge strips comprise lengthwise portions folded back for reinforcement.

4. The memorandum book of claim 1 comprising successive sheets comprising contrasting surface appearance whereby detached areas become distinctly noticeable.

5. The memorandum book of claim 1 wherein said sheets comprise weakened tear lines defining inner borders of said outer edge strips.

6. The memorandum book of claim 5 wherein said weakened tear lines comprise closely spaced perforations.

7. The memorandum book of claim 1 comprising means binding inner edge portions of said sheets permanently together and weakened tear lines separating said inner edge portions from the remainders of said sheets.

8. The memorandum book of claim 7 wherein said weakened tear lines separating said inner edge portions from the remainders of said sheets comprise closely spaced perforations.

9. The memorandum book of claim 1 wherein each of said detachable areas is separated at its upper and lower border by a slit of sufficient length for a person to insert a finger and thereby grip said area and tear it out of said memorandum book.

10. The memorandum book of claim 9 wherein said binding means comprise binder wire, and end portions of said areas defining at least one aperture enclosing said binder wire.

11. The memorandum book of claim 9 comprising weakened tear lines extending from each of said slits to said binding means.

12. The memorandum book of claim 11 wherein said extending weakened tear lines comprise closely spaced perforations.

13. The memorandum book of claim 9 comprising vertical slits between said areas and said vertical strip, said vertical slits being bordered by tearable tabs connecting said areas to said vertical strip and to each other.

14. The memorandum book of claim 9 wherein said sheets comprise weakened tear lines defining inner borders of said outer edge strips.

15. The memorandum book of claim 14 wherein said weakened tear lines comprise closely spaced perforations.

16. The memorandum book of claim 9 wherein said outer edge strips comprise lengthwise portions folded back for reinforcement.

17. An inscribable sheet for a memorandum book comprising:

(A) upper and lower horizontal strips and an outer vertical edge strip integral therewith, said strips forming a supporting frame, (B) a plurality of detachable rectangular areas extending from said edge strip parallel to said horizontal strips.

18. The inscribable sheet of claim 17 wherein said edge strip comprises a lengthwise portion folded back for reinforcement.

19. The inscribable sheet of claim 17 wherein each of said detachable areas is separated at its upper and lower border by a slit of sufficient length for a person to insert a finger and thereby grip said strip for the purpose of tearing it from said sheet.

20. The inscribable sheet of claim 19 wherein said edge strip comprises a lengthwise portion folded back for reinforcement.

* * * * *